US005639719A

United States Patent [19]

Tanaka et al.

[11] Patent Number: 5,639,719

[45] Date of Patent: Jun. 17, 1997

[54] LUBRICATING OIL CONTAINING AROMATIC ETHER COMPOUNDS

[75] Inventors: Masahide Tanaka; Masayasu Ishibashi; Takashi Hayashi; Hajime Oyoshi; Tetsuo Hayashi, all of Yamaguchi; Kinya Mizui, Ichihara, all of Japan

[73] Assignee: Mitsui Petrochemical Industries, Ltd., Tokyo, Japan

[21] Appl. No.: 605,088

[22] PCT Filed: Jul. 6, 1995

[86] PCT No.: PCT/JP95/01354

§ 371 Date: Mar. 6, 1996

§ 102(e) Date: Mar. 6, 1996

[87] PCT Pub. No.: WO96/01301

PCT Pub. Date: Jan. 18, 1996

[30] Foreign Application Priority Data

Jul. 6, 1994 [JP] Japan ..... 6-155020

[51] Int. Cl.[6] ..... C10M 129/16

[52] U.S. Cl. ..... 508/580; 252/68

[58] Field of Search ..... 252/52 A, 68; 508/580

[56] References Cited

U.S. PATENT DOCUMENTS

| | | | |
|---|---|---|---|
| 3,019,187 | 1/1962 | Panzer et al. | 252/52 A |
| 4,248,726 | 2/1981 | Uchinuma et al. | 252/52 A |
| 4,250,047 | 2/1981 | Katabe et al. | 252/52 A |
| 4,479,882 | 10/1984 | Zoleski et al. | 252/52 A |
| 4,539,128 | 9/1985 | Grossmann et al. | 252/52 A |
| 4,851,144 | 7/1989 | McGraw et al. | 252/52 A |
| 5,403,503 | 4/1995 | Seiki et al. | 252/52 A |

FOREIGN PATENT DOCUMENTS

| | | |
|---|---|---|
| 58-38793 | 3/1983 | Japan . |
| 2-258895 | 10/1990 | Japan . |
| 4-45194 | 2/1992 | Japan . |
| 6-49472 | 2/1994 | Japan . |

*Primary Examiner*—Jacqueline V. Howard

*Attorney, Agent, or Firm*—Birch, Stewart, Kolasch & Birch, LLP

[57] ABSTRACT

A lubricating oil containing an aromatic ether compound represented by the general formula, $(R^1)_n$Ph—O— $(R^2O)_m$—$R^3$, wherein $R^1$ stands each independently for a particular hydrocarbon group, an etheric oxygen-containing hydrocarbon group, an alkoxyl group, or a halogen-substituted hydrocarbon group, $R^2$ stands each independently for an alkylene group having 2 to 4 carbon atoms, $R^3$ stands for a hydrocarbon group having 1 to 12 carbon atoms, Ph stands for an aromatic substituent, n stands for an integer of from 1 to 5, and m stands for an integer of from 1 to 30. The lubricating oil has excellent lubricating property, cleaning property and electrically insulating property, exhibits excellent sealing property owing to its high viscosity and wear resistance, and further exhibits excellent compatibility with R-134a, etc. The lubricating oil can be favorably used for the refrigerators such as of electric refrigerators and room air conditioners that use R-134a as a coolant.

8 Claims, 2 Drawing Sheets

LUBRICATING OIL CONTAINING AROMATIC ETHER COMPOUNDS

TECHNICAL FIELD

The present invention relates to a lubricating oil containing aromatic ether compounds.

More specifically, the invention relates to a lubricating oil containing a particular aromatic ether compound, exhibiting excellent compatibility with ozone layer non-depleting hydrogenated fluorocarbons (HFC) such as R-134a that are used as coolant for refrigerators, as well as excellent lubricating property, cleaning property and electrically insulating property.

BACKGROUND ART

Lubricating oils include gear oils for industrial use, engine oils, lubricating oils for refrigerators, lubricating oils for fibers, lubricating oils for rolling, oils for electric insulation and the like oils.

As it has now been urged to operate industrial machinery under ever severe conditions, it has been demanded to produce gear oils for industrial use that are capable of maintaining lubricating property and cleaning property up to high temperature ranges. In a step of baking finish and a step of baking foods, in particular, higher performance is required in regard to lubricating property and cleaning property. For such applications, there have heretofore been used lubricating oils of the types of synthetic hydrocarbons, carboxylic esters and glycols.

However, the synthetic hydrocarbon oils and carboxylic ester oils are not still satisfactory in regard to lubricating property, form carbonates after heated for extended periods of time, and are not capable of playing the role of lubricating oils under high-temperature conditions. On the other hand, the glycol lubricating oils have a merit of forming carbonates in small amounts even after heated for extended periods of time but have insufficient lubricating property and strong hygroscopic property, leaving room for improvement in regard to lubricating property and hygroscopic property.

Accompanying the trend toward producing automotive engines of higher performance, furthermore, it has been urged to produce engine oils that maintain lubricating property, cleaning property and dispersing property at higher temperatures even after used for longer periods of time. If it is attempted to meet such demands by selecting additives, the additives are inevitably used in large amounts bringing about a harmful effect, i.e., sedimentation of a mayonnaise sludge. It has heretofore been attempted to use a mineral oil as a base oil together with the synthetic hydrocarbon oil or the carboxylic ester oil without, however, satisfactory results in regard to lubricating property, cleaning property and dispersing property when used at high temperatures for extended periods of time. Unlike the lubricating oils for the automotive engines, i.e., for the four-cycle engines, on the other hand, the lubricating oils for the two-cycle engines are burned being added to the gasoline and, hence, its cleaning property is most important. Castor oils and polybutenes have heretofore been used as lubricating oils for the two-cycle engines, but their lubricating property and cleaning property are not still satisfactory.

Gear oils for automobiles and, particularly, gear oils for ATF must have small coefficients of friction and must be aged little. Therefore, there have heretofore been used a friction-reducing agent and a friction-adjusting agent. However, gear oils for automobiles containing these additives still have a problem in that their coefficients of friction change greatly with the passage of time.

So far, lubricating oils of the types of carboxylic ester and glycol have been used for the fibers satisfying, however, neither lubricating property nor cleaning property.

A lubricating oil chiefly consisting of beef tallow has long been used for the rolling. This lubricating oil features excellent lubricating property and rolling efficiency but has very poor cleaning property, making it necessary to carry out the step of cleansing the beef tallow. Moreover, a lubricating oil of the type of carboxylic ester has been used for the rolling featuring very good cleaning property but low practicability because of its poor lubricating property.

In the refrigerators in which ozone layer non-depleting R-134a ($CH_2F—CF_3$) has now been used as the coolant gas, mineral oils and alkylbenzene compounds that were used as lubricating oils are now no longer usable because they lack compatibility with the coolant gas. At present, a glycol ether lubricating oil has been developed for lubricating the refrigerators that use the above-mentioned coolant gas.

U.S. Pat. No. 4,755,316 discloses a composition for compression refrigerators, comprising a tetrafluoroethane and a polyoxyalkylene glycol having a molecular weight of 300 to 2,000 and a kinematic viscosity of about 25 to 150 cst at 37° C.

However, the glycol ether lubricating oils have insufficient heat stability, strong hygroscopic property and cause rubber sealing members such as of NBR to shrink and hardened.

In modern refrigerators for car air conditioners, furthermore, there has been employed a through-vane type rotary compressor featuring both reduced size and increased efficiency. The lubricating oil for the through-vane type rotary compressor must have a large viscosity from the standpoint of sealing property and wear resistance. However, compounds having a glycol ether structure are not utilizable since they exhibit poor compatibility with respect to the ozone layer non-depleting R-134a when their molecular weights are increased to exhibit increased viscosities.

In recent years, furthermore, poly ester and carboxylic ester lubricating oils called hindered ester have been developed for lubricating the refrigerators that use the ozone layer non-depleting hydrogenated fluorocarbons (HFC) as the coolant. However, these lubricating oils form carboxylic acid upon the hydrolysis or the thermal decomposition resulting in the occurrence of corrosion and wear of metals or copper-plating phenomenon in the refrigerators due to the carboxylic acid. Therefore, these lubricating oils bring about a problem concerning the durability of the refrigerators.

In the electric refrigerators and room air conditioners, furthermore, the electric wirings are immersed in the lubricating oil. Therefore, leakage of current and short-circuiting must be avoided. From this point of view, the lubricating oil for the electric refrigerators and room air conditioners must have excellent electrically insulating property in addition to lubricating property and compatibility with the hydrogenated fluorocarbons. However, the carboxylic ester lubricating oils have poor electrically insulating property and are not suited for the electric refrigerators and room air conditioners.

It has therefore been desired to provide a lubricating oil having excellent lubricating property and electrically insulating property yet exhibiting excellent compatibility with ozone layer non-depleting hydrogenated fluorocarbons such as R-134a.

SUMMARY OF THE INVENTION

The present invention is to solve the above-mentioned problems inherent in the prior art, and its object is to provide a highly thermally stable lubricating oil having excellent lubricating property, cleaning property, electrically insulating property and compatibility with ozone layer non-depleting hydrogenated fluorocarbons (HFC) yet suppressing the evolution of carboxylic acid and carbonic acid gas.

In particular, the object of the present invention is to provide a lubricating oil that can be preferably used for the refrigerators such as electric refrigerators and room air conditioners that use ozone layer non-depleting hydrogenated fluorocarbons as a coolant.

According to the present invention, there is provided a lubricating oil containing an aromatic ether compound represented by the following general formula [I], $$(R^1)_n Ph—O—(R^2O)_m—R^3 \quad [I]$$

wherein $R^1$ stands each independently for a hydrocarbon group having 1 to 20 carbon atoms, an etheric oxygen-containing hydrocarbon group having 2 to 30 carbon atoms, an alkoxyl group having 1 to 20 carbon atoms, or a halogen-substituted hydrocarbon group having 1 to 10 carbon atoms, $R^2$ stands each independently for an alkylene group having 2 to 4 carbon atoms, $R^3$ stands for a hydrocarbon group having 1 to 12 carbon atoms, Ph stands for an aromatic substituent, n stands for an integer of from 1 to 5, and m stands for an integer of from 1 to 30.

The above-mentioned aromatic ether compound of the present invention has excellent lubricating property, cleaning property and electrically insulating property. Therefore, the lubricating oil of the present invention which comprises the above-mentioned aromatic ether compound exhibits excellent lubricating property, cleaning property and electrically insulating property, and can be extensively used for the refrigerators such as of car air conditioners, electric refrigerators and room air conditioners, and can be further used as an industrial gear oil, as an engine oil for automobiles, as a gear oil for automobiles, as a lubricating oil for fibers and as a lubricating oil for rolling.

In addition to the above-mentioned excellent properties, the lubricating oil of the present invention exhibits excellent compatibility with ozone layer non-depleting hydrogenated fluorocarbons (HFC) such as R-134a, R-152a and R-32, excellent compatibility with hydrogenated chlorofluorocarbons (HCFC) having small ozone depletion potential such as R-22, R-123 and R-124 and excellent compatibility with a mixture of these hydrogenated products, does not form carboxylic acid unlike esters, and further exhibits particularly excellent thermal stability. Accordingly, the lubricating oil of the present invention evolves carbonic acid gas in amounts very smaller than those of the conventional polycarbonates. Therefore, the lubricating oil of the present invention can be favorably used for lubricating the refrigerators.

DETAILED DESCRIPTION OF THE INVENTION

Figure 1:
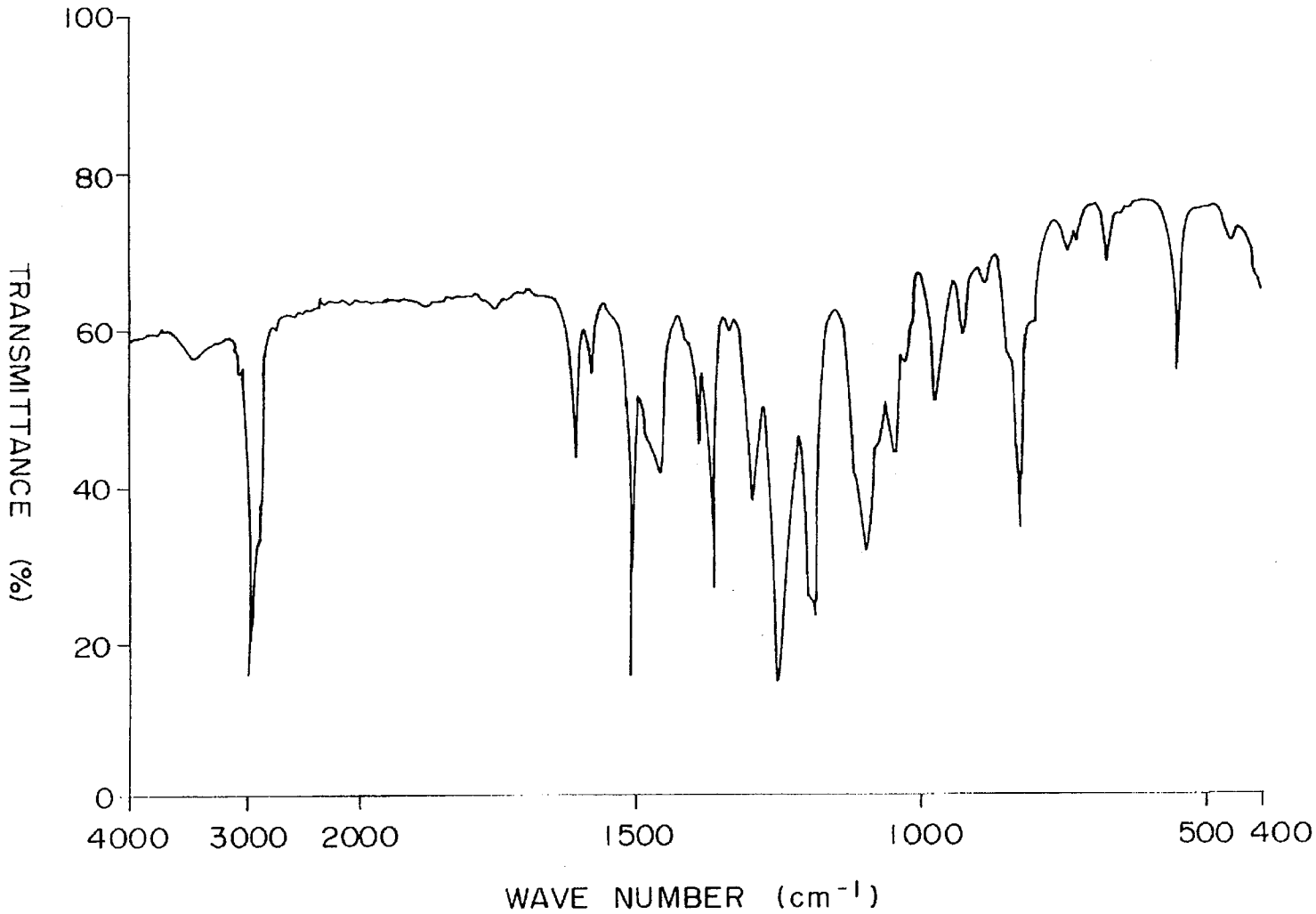
FIG. 1 is a diagram of an infrared-ray absorption spectrum of an aromatic ether compound (Example 2) used as a lubricating oil of the present invention.

The lubricating oil of the present invention contains an aromatic ether compound represented by the following general formula [I], $$(R^1)_n Ph—O—(R^2O)_m—R^3 \quad [I]$$

wherein $R^1$ stands each independently for a hydrocarbon group having 1 to 20 carbon atoms, an etheric oxygen-containing hydrocarbon group having 2 to 30 carbon atoms, an alkoxyl group having 1 to 20 carbon atoms, or a halogen-substituted hydrocarbon group having 1 to 10 carbon atoms, $R^2$ stands each independently for an alkylene group having 2 to 4 carbon atoms, $R^3$ stands for a hydrocarbon group having 1 to 12 carbon atoms, Ph stands for an aromatic substituent, n stands for an integer of from 1 to 5, and m stands for an integer of from 1 to 30.

Concrete examples of the group $R^1$ include straight-chain or branched-chain hydrocarbons such as methyl group, ethyl group, n-propyl group, isopropyl group, n-butyl group, isobutyl group, s-butyl group, t-butyl group, pentyl group, isopentyl group, neopentyl group, n-hexyl group, 2,3-dimethylbutyl group, isohexyl group, n-heptyl group, isoheptyl group, n-octyl group, 2-ethylhexyl group, isooctyl group, n-nonyl group, isononyl group, n-decyl group, isodecyl group, n-undecyl group, isoundecyl group, n-dodecyl group, isododecyl group, n-tridecyl group, isotridecyl group, n-tetradecyl group, isotetradecyl group, n-pentadecyl group, isopentadecyl group, n-hexadecyl group, isohexadecyl group, n-heptadecyl group, isopentadecyl group, n-octadecyl group, isooctadecyl group, n-nonylde cyl group, isononyldecyl group, n-icosanyl group, isoicosanyl group, 4-methylpentyl group and the like groups;

straight-chain or branched-chain alkoxyl groups such as methoxy group, ethoxy group, propoxy group, butoxy group, and the like groups;

straight-chain or branched-chain hydrocarbons such as ethylene glycol monomethyl ether group, ethylene glycol monoethyl ether group, ethylene glycol monopropyl ether group, ethylene glycol monobutyl ether group, diethylene glycol monomethyl ether group, diethylene glycol monoethyl ether group, diethylene glycol monobutyl ether group, triethylene glycol monomethyl ether group, propylene glycol monomethyl ether group, propylene glycol monopropyl ether group, propylene glycol monobutyl ether group, dipropylene glycol monomethyl ether group, dipropylene glycol monobutyl ether group, butylene glycol monomethyl ether group, butylene glycol monobutyl ether group and the like groups; and halogen-substituted straight-chain or branched-chain hydrocarbons such as $Cl_3C$— group, $Cl_2HC$— group, $ClH_2C$— group, $CF_3$— group, $FCH_2$— group, $HCF_2CH_2$— group, $HCF_2CF_2CH_2O$— group, $CF_3$—$CH_2O$— group, $H(C_2F_4)_n$— group (n=1 to 3), $CF_3$—CHF—$CF_2O$— group and the like groups.

Concrete examples of the group Ph include phenylene group and the like groups.

Concrete examples of the group $R^2$ include straight-chain or branched-chain alkylene groups such as ethylene group, propylene group and butylene group.

Concrete examples of the group $R^3$ include straight-chain or branched-chain hydrocarbons such as methyl group, ethyl group, n-propyl group, isopropyl group, n-butyl group, isobutyl group, s-butyl group, t-butyl group, pentyl group, isopentyl group, neopentyl group, n-hexyl group, 2,3-dimethylbutyl group, isohexyl group, n-heptyl group, isoheptyl group, n-octyl group, 2 -ethylhexyl group, isooctyl group, n-nonyl group, isononyl group, n-decyl group, isodecyl group, n-undecyl group, isoundecyl group, n-dodecyl group, isododecyl group, 4-methylpentyl group and the like groups.

Examples of the aromatic ether compound represented by the above-mentioned general formula [I] include the following compounds:

(1) $R^1—C_6H_4—O—(C_xH_{2x}O)_m—R^3$

[$R^1=C_pH_{2p-1}$ (p=1 to 12), x=2 to 4, m=1 to 3, $R^3=C_qH_{2q}-1$ (q=1 to 9)]

(2) $(R^1)_2(C_6H_3)—O—(C_xH_{2x}O)_m—R^3$

[$R^1=C_pH_{2p-1}$ (p=1 to 6), x=2 to 4, m=1 to 3, $R^3=C_qH_{2q-1}$ (q=1 to 9)]

(3) $CH_3O—C_6H_4—O—(C_xH_{2x}O)_m—R^3$

[x=2 to 4, m=1 to 3, $R^3=C_qH_{2q}-1$ (q=1 to 9)]

(4) $CF_3—C_6H_4—O—(C_xH_{2x}O)_m—R^3$

[x=2 to 4, m=1 to 3, $R^3=C_qH_{2q}-1$ (q=1 to 9)]

(5) $R^1—C_6H_4—O—(C_xH_{2x}O)_m—R^3$

[$R^1=R^3—O—(C_xH_{2x}O)_m—$, x=2 to 4, m=1 to 3, $R^3=C_qH_{2q}-1$ (q=1 to 9)].

The aromatic ether compound represented by the above-mentioned general formula [I] can be prepared by, for example, a method that is described below.

First, (a) an aromatic ring-containing alcohol represented by the general formula [II]

$$(R^1)_nPh—O—(R^2O)_m—H \quad [II]$$

(wherein $R^1$, $R^2$, Ph, n and m have the same meanings as $R^1$, $R^2$, Ph, n and m in the above-mentioned general formula [I]), and (b) an olefin having 2 to 12 carbon atoms are reacted in the presence of an acid catalyst, in order to add the olefin to a hydroxyl group of the aromatic ring-containing alcohol.

The catalyst is removed by filtration from the reaction solution and, then, an aromatic ether compound represented by the above-mentioned general formula [I] is isolated by distillation.

After filtering, as required, the reaction liquid is neutralized with an alkali and is washed with water. In this case, to facilitate oil-water separation, the reaction solution may be diluted with a solvent. As the solvent, there can be used hydrocarbon solvents such as hexane, toluene, etc., and ether solvents such as dioxane, isobutyl ether, etc.

Concrete examples of the aromatic ring-containing alcohol (a) include:

a p-t-butylphenol to which is added one mol of ethylene oxide;

a p-t-amylphenol to which is added one mol of ethylene oxide;

an o, p-di-t-butylphenol to which is added one mol of ethylene oxide;

a p-isooctylphenol to which is added one mol of ethylene oxide;

a p-isononylphenol to which is added one mol of propylene oxide;

an m-isopropylphenol to which is added one mol of ethylene oxide;

a p-isopropylphenol to which is added one mol of ethylene oxide;

a p-t-butylphenol to which is added 3 mols of ethylene oxide;

a p-isooctylphenol to which is added 3 mols of ethylene oxide;

a p-isononylphenol to which is added one mole of ethylene oxide;

a p-t-butylphenol to which is added one mol of propylene oxide; and a p-t-amylphenol to which is added one mol of propylene oxide.

Furthermore, concrete examples of the olefin having 2 to 12 carbon atoms include ethylene, propylene, 1-butene, 2-butene, isobutene, 1-pentene, 2-pentene, 2-methyl-1-butene, 3-methyl-1-butene, 2-methyl-2-butene, 1-hexene, 1-heptene, 1-octene, 1-nonene, 1-decene, 1-undecene and 1-dodecene.

As the acid catalyst, there can be usually used an inorganic acid, an organic acid, an acidic ion-exchange resin, a solid acid or a Lewis acid.

The reaction temperature is from 0° to 300° C., preferably, from 10° to 100° C. and, more preferably, from 20° to 60° C. The reaction time is from 0.1 to 300 hours, preferably, from 0.2 to 50 hours and, more preferably, from 1 to 10 hours.

In reacting the aromatic ring-containing alcohol (a) with the olefin (b) having 2 to 12 carbon atoms, there may be used a solvent as required. In this case, the solvent is used in such an amount that the ratio of solvent/aromatic ring-containing alcohol (on the basis of weight) is from 0.2 to 100 and, preferably, from 1 to 10. Any solvent can be used provided it does not adversely affect the reaction.

The aromatic ring-containing alcohol (a) and the olefin (b) are used in such amounts that the number of mols of (b)/the number of mols of (a) is from 0.1 to 10, preferably, from 0.5 to 5 and, more preferably, from 0.8 to 3.

Described below is another method of producing the aromatic ether compound of the present invention.

That is, the aromatic ring-containing alcohol (a) and a dimethyl sulfate (c) are reacted in the presence of an alkali, water and a quaternary ammonium salt, and a hydroxyl group of the aromatic ring-containing alcohol is methyl-etherified. Then, the reaction product is washed with water. After the solvent is removed, the reaction product is subjected to the isolation by distillation to obtain the aromatic ether compound represented by the above-mentioned general formula [I].

Concrete examples of the aromatic ring-containing alcohol (a) are as described above.

Concrete examples of the alkali include NaOH and KOH, and concrete examples of the quaternary ammonium salt include $(C_2H_5)_4NCl$, $(C_2H_5)_4NBr$, $(C_2H_5)_4NI$, $(C_2H_5)_4NHSO_4$, $(C_2H_5)_4NClO_4$, $(C_4H_9)_4NCl$, $(C_4H_9)_4NBr$, $(C_4H_9)_4NI$, $(C_4H_9)_4NHSO_4$, $(C_4H_9)_4NClO_4$ and the like.

In reacting the aromatic ring-containing alcohol (a) with the dimethyl sulfate (c), furthermore, a solvent may be used. The solvent is preferably a hydrocarbon solvent such as hexane or toluene, or an ether solvent such as isobutyl ether. In this case, the solvent is used in such an amount that the ratio of solvent/aromatic ring-containing alcohol (a) (weight basis) is from 0.2 to 100 and, preferably, from 1 to 10.

Furthermore, water is used in such an amount that the ratio of water/aromatic ring-containing alcohol (a) (weight basis) is from 0.05 to 10 and, preferably, from 0.2 to 1.

The aromatic ring-containing alcohol (a) and the dimethyl sulfate (c) are used in such amounts that the mol ratio of dimethyl sulfate (c)/aromatic ring-containing alcohol (a) is from 0.5 to 10, preferably, from 0.5 to 5 and, more preferably, from 0.8 to 3.

The alkali is used in such an amount that the mol ratio of alkali/dimethyl sulfate (c) is from 0.5 to 50 and, preferably, from 1 to 10.

The quaternary ammonium salt is used in such an amount that the mol ratio of quaternary ammonium salt/dimethyl sulfate (c) is from $10^{-1}$ to $10^{-5}$ and, preferably, from $10^{-2}$ to $10^{-4}$.

The reaction temperature is from −20° C. to 150° C., preferably, from −10° C. to 100° C. and, more preferably, from 0° C. to 80° C. The reaction time is from 0.1 to 300 hours, preferably, from 0.2 to 50 hours and, more preferably, from 1 to 10 hours.

The aromatic ether compound prepared as described above exhibits excellent lubricating property, cleaning property, as well as a volume resistivity of the order of from $10^{12}$ to $10^{14}$ Ω·cm, and features high electrically insulating property compared with that of the conventional polyether lubricating oils. The aromatic ether compound does not form acid unlike the ester lubricating oils, and does not cause corrosion to the machinery. Therefore, the lubricating oil containing the aromatic ether compound can be desirably used particularly for the applications where electrically insulating property is required.

Moreover, the lubricating oil of the present invention may contain other components in addition to the above-mentioned aromatic ether compound.

When used as an industrial gear oil, as an engine oil for automobiles and as a gear oil for automobiles, the lubricating oil of the present invention may be further blended with other components such as mineral oils like neutral oil or blight stock in addition to the above-mentioned aromatic ether compound. The lubricating oil may be further blended with an α-olefin oligomer such as liquid polybutene, liquid decene oligomer or the like; ester of carboxylic acod such as diisooctyl adipate, diisooctyl sebacate, dilauryl sebacate, pentaerythritol, tetraester of 2-ethylhexanoic acid, triester of hexanoic acid of trimethylolpropane and the like; plant oil and the like. According to the present invention, furthermore, it is allowable to add to the lubricating oil widely known additives such as cleaning/dispersing agent, anti-oxidizing agent, load carrying agent, oiliness agent, and pour point depressant that have been disclosed in Toshio Sakurai, "Petroleum Product Additives" (Saiwai Shobo Co., 1974) in amounts that do not impair the object of the invention.

When used as the above-mentioned industrial gear oil, engine oil for automobiles and gear oil for automobiles, the lubricating oil of the present invention may be used in the form of a composition being blended with additives, assistant base oils, etc. as described below.

For instance, those compositions using a mineral oil such as paraffin oil or naphthene oil as a base oil.

Furthermore, compositions blended with poly α-olefin (polybutene, 1-octene oligomer, 1-decene oligomer, etc.), alkylbenzene, alkylnaphthalene, diester (ditridecyl glutarate, di-2-ethylhexyl adipate, diisodecyl adipate, ditridecyl adipate, di-2-ethylhexyl sebacate, etc.), polyol ester (pentaerythritol 2-ethyl hexanoate, pentaerythritol pelargonate, trimethylolpropane pelargonate, trimethylolpropane hexanoate, etc.), polyoxyalkylene glycol, polyphenyl ether, silicone oil, or a mixture of two or more kinds thereof.

It is desired that these oils are mixed in amounts of not larger than 50% by weight and, preferably, not larger than 30% by weight with respect to the whole amount of the lubricating oil.

When the lubricating oil of the present invention is used for the refrigerators that use HFC such as R-134a, R-152a or R-32 as the ozone layer non-depleting coolant gas, other components that can be added to the aromatic ether compound are limited to acetals, glycol ethers and carboxylic esters from the standpoint of compatibility. However, these components deteriorate heat resistance, compatibility with R-134a and hygroscopic property. Therefore, these components should be added in amounts of smaller than 60% by weight per 100% by weight of the lubricating oil. The lubricating oil for refrigerators of the present invention may be further blended with an epoxy compound that serves as a chlorine-trapping agent in case of the infiltration of phenolic stabilizer, defoaming agent or chlorine-containing coolant. Moreover, the lubricating oil for the refrigerators may be blended with the above-mentioned widely known additives for the lubricating oils. The lubricating oil for the refrigerators may be further blended with hydrogenated fluorocarbons (HFC) such as R-134a, R-152a or R-32, hydrogenated chlorofluorocarbons (HCFC) having small ozone depletion potential such as R-22, or a mixture of these hydrogenated products.

As other components of glycol ethers and carboxylic esters that can be added to the lubricating oil for the refrigerators, there can be preferably used polyglycol such as polyoxyalkylene glycol, polyoxyalkylene glycol monoalkyl ether, polyoxyalkylene glycol dialkyl ether, polyoxyalkylene glycol glycerol ether, complex esters of monool, diol, monocarboxylic acid and dicarboxylic acid, esters of carboxylic acid and neopentyl-type polyol such as pentaerythritol, trimethylolpropane or dimer or trimer thereof, complex esters of neopentyl-type polyol, monocarboxylic acid and carboxylic acid, carbonic ester having a structure different from that of the present invention, fluorosilicone oil, perfluoropolyether, polyethylene trifluoride chloride, etc. These oils may be used in a single kind or in a combination of several kinds, and in amounts of not larger than 80% by weight, preferably, not larger than 70% by weight and, more preferably, not larger than 50% by weight per the whole amount of the lubricating oil.

When used for the refrigerators, the lubricating oil of the present invention may be further blended with at least one kind of phosphorus compound selected from the group consisting of phosphoric ester, chlorinated phosphoric ester, acid phosphoric ester, amine salt of acid phosphoric ester, tertiary phosphite and secondary phosphite in order to further improve wear resistance and resistance against the electric charge. These phosphorus compounds are esters of phosphoric acid or phosphorous acid and alkanol or polyether-type alcohol, or derivatives thereof. Concrete examples of phosphoric ester include tributyl phosphate, triphenyl phosphate and tricresyl phosphate. Concrete examples of chlorinated phosphoric ester include trischloroethyl phosphate, trisdichloropropyl phosphate and the like. Concrete examples of acid phosphoric ester include ethyl acid phosphate, isopropyl acid phosphate, butyl acid phosphate, 2-ethylhexyl acid phosphate, lauryl acid phosphate, tetradecyl acid phosphate, pentadecyl acid phosphate, hexadecyl acid phosphate, heptadecyl acid phosphate, octadecyl acid phosphate, stearyl acid phosphate, isostearyl acid phosphate and oleyl acid phosphate. Concrete examples of amine salt of acid phosphoric ester include octylamine, oleylamine, coconutamine and beef tallowamine of the acid phosphoric ester. Concrete examples of tertiary phosphite include triphenyl phosphite, tricresyl phosphite, diphenylisodecyl phosphite, phenyldiisodecyl phosphite, tristearyl phosphite and trilauryl phosphite. Concrete examples of the secondary phosphite include di-2-ethylhexylhydrodiene phosphite, dilaurylhydrodiene phosphite and dioleylhydrogen phosphite. These phosphorus compounds can be used being mixed together. It is desired that these phosphorus compounds are blended in an amount of from 0.0005 to 5.0% by weight and, preferably, from 0.001 to 3.0% by weight per the whole amount of the lubricating oil.

When used for the refrigerators, the lubricating oil of the present invention can be blended with at least one epoxy compound or an ether compound selected from the group consisting of phenylglycidyl ether-type epoxy compound, alkylglycidyl ether-type epoxy compound, cycloaliphatic-type epoxy compound, glycidyl ester-type epoxy compound, epoxylated fatty acid monoester, epoxylated plant oil and crown ethers.

Here, examples of the phenylglycidyl ether-type epoxy compound include phenylglycidyl ether and alkylphenylglycidyl ether. The alkylphenylglycidyl ether has 1 to 3 alkyl groups with 1 to 13 carbon atoms, and its preferred examples include butylphenylglycidyl ether, pentylphenylglycidyl ether and hexylphenylglycidyl ether.

Preferred examples of the alkylglycidyl ether-type epoxy compound include hexylglycidyl ether, heptylglycidyl ether, octylglycidyl ether, nonylglycidyl ether and decylglycidyl ether.

Examples of the glycidyl ester-type epoxy compound include phenylglycidyl ester, alkylglycidyl ester, alkenylglycidyl ester and, preferably, glycidyl benzoate, glycidyl acrylate and glycidyl methacrylate.

Examples of the epoxylated fatty acid monoester include esters of an epoxylated fatty acid having 12 to 20 carbon atoms and an alcohol having 1 to 8 carbon atoms, phenol or alkylphenol. In particular, there can be preferably used butyl, hexyl, benzyl, cyclohexyl, methoxyethyl, octyl, phenyl and butylphenyl ester of epoxystearic acid.

As the epoxylated plant oil, there can be exemplified epoxy compounds of such plant oils as soybeen oil, linseed oil, cotton seed oil, etc.

Among these epoxylated compounds, preferred examples include phenylglycidyl ether-type epoxy compound, epoxylated fatty acid monoester and cycloaliphatic-type epoxy compound. Among them, particularly preferred examples are phenylglycidyl ether, butylphenylglycidyl ether, and a mixture thereof.

It is desired that these epoxy compounds are blended in amounts of from 0.01 to 5.0% by weight and, preferably, from 0.1 to 2.0% by weight per the lubricating oil.

When used for the refrigerators, furthermore, the lubricating oil of the present invention can be further blended with additives that have heretofore been added to the oils for the refrigerators such as phenol-type antioxidizing agent like di-tert-butyl-p-cresol or bisphenol A, amine-type antioxidizing agent like phenyl-o-naphthylamine, N,N-di-(2-naphthyl)-p-phenylene diamine, wear-preventing agent such as zinc dithiophosphate, extreme pressure additives such as paraffin chloride, sulfur compound and the like, oiliness agent such as fatty acid, defoaming agent such as silicone oil, and metal inactivating agent such as benzotriazole in a single kind or in a combination of plural kinds in order to further improve properties. These additives are added in a total amount of usually not larger than 10% by weight and, preferably, not larger than 5% by weight per the lubricating oil.

When other refrigerator oils and additives are blended in the present invention, the aromatic ether compound of the present invention may be used in an amount of not smaller than 5% by weight per the lubricating oil but should preferably be used in an amount of usually not smaller than 50% by weight and, preferably, not smaller than 70% by weight.

When used for the rolling, for machining metals and for the fibers, the lubricating oil of the present invention may be used as an emulsion by using a suitable emulsifying agent.

INDUSTRIAL APPLICABILITY

The lubricating oil of the present invention exhibits excellent lubricating property, cleaning property and electrically insulating property, and further exhibits excellent sealing property because of its high viscosity and abrasion resistance.

Besides, the lubricating oil of the invention does not form carboxylic acid by degradation unlike the ester-type lubricating oils. Therefore, the lubricating oil of the present invention can be extensively used as a lubricating oil for the refrigerators of car air conditioners, electric refrigerators, room air conditioners, as an industrial gear oil, as an engine oil for automobiles, as a gear oil for automobiles, as a lubricating oil for fibers, as a lubricating oil for rolling and as an oil for electric insulation.

Moreover, the lubricating oil of the present invention exhibits not only the above-mentioned excellent properties but also excellent compatibility with ozone layer non-depleting hydrogenated fluorocarbons (HFC) such as R-134a, R-152a and R-32, excellent compatibility with hydrogenated chlorofluorocarbons (HCFC) having small ozone depletion potential such as R-22, R-123 and R-124, and excellent compatibility with mixtures thereof. Accordingly, the lubricating oil of the invention can be favorably used for the refrigerators such as electric refrigerators and room air conditioners that use the above-mentioned hydrogenated compounds as coolants.

The present invention will now be described by way of Examples, but it should be noted that the present invention is in no way limited thereto only.

In Examples and Comparative Examples, analysis of ether compounds and evaluation of performance of the lubricating oils were conducted in compliance with the following testing methods.

(1) Method of Analysis a. Purity

The purity was measured by using a gas chromatography (GC) manufactured by Shimazu Mfg. Co. The measuring conditions were as described below.

Column: DB-17, 0.25 ϕ×30 m

Detector: FID

Temperature: 100° C. to 270° C.

Temperature rising rate: 10° C./min.

Carrier gas: helium b. Infrared-ray absorption spectrum (IR)

The sample was applied to between KBr plates and was measured by using an infrared-ray spectrometer A-302 manufactured by Nippon Bunko Co.

c. NMR Analysis.

Measured in compliance with a protonic NMR method [JNM-GX270 manufactured by Nippon Denshi Co.].

(2) Method of Evaluation a. Kinematic viscosity b. Load carrying value

By using a Falex testing machine, the running-in was carried out for five minutes under the load of 250 lbf. The load was then increased and a value was found at which seizure took place. The value at this moment was regarded to be load carrying value.

c. Volume resistivity

The volume resistivity was found in compliance with ASTM D 257.

d. Compatibility with R-134a (1) One milliliter of a sample was introduced into a test tube having an inner diameter of 10 mm and a depth of 20 cm, and the R-134a was slowly introduced from a container into the test tube while it was being cooled in a dry ice-acetone bath until its amount was larger than that of the sample. Then, these liquids was stirred using a spatula. The mixture was transferred into a coolant bath maintained at −10 Åé, and dissolving property was checked when the volume ratio of sample/R-134a was 1/1. The sample was regarded to be good when they were completely homogeneous and was regarded to be bad when it did not dissolve.

(2) In order to more closely examine the compatibility between the ether product and the R-134a, the lubricating oil and the R-134a were introduced into a glass tube by changing their ratio, in order to find a limit temperature (critical temperature) at which the two became compatible with each other.

EXAMPLE 1

Into a flask having a capacity of 3 liters were fed 502 g of a p-t-amylphenol/1 mole ethylene oxide aduct [tradename PTAP-EO, molecular weight of 208 produced by Toho Kagaku Kogyo Co.], 1000 g of a dioxane and 50 g of a catalyst (Amberlist 15 produced by Organo Co.), and the reaction was carried out for 9 hours while feeding isobutene thereto at room temperature.

After the reaction, the catalyst was removed, followed by isolation by distillation to obtain 402 g of an aromatic ether compound.

The obtained aromatic ether compound was liquid and possessed a purity of 97% as a result of GC analysis. From the result of $^1$H-NMR analysis and IR analysis, it was learned that the aromatic ether compound was a p-t-amylphenoxyethylene mono-t-butyl ether having the following structure, $$CH_3CH_2C(CH_3)_2C_6H_4—O—C_2H_4O—C(CH_3)_3$$

Measurement of the obtained aromatic ether compound by $^1$H-NMR indicated the following peaks on the chart. During the measurement, $CDCl_3$ was used as a solvent.

0.66 ppm, 1.22 ppm, 1.24 ppm, 1.60 ppm, 3.70 ppm, 4.05 ppm, 6.85 ppm, 7.20 ppm.

Described below are the data of infrared-ray absorption spectrum of the obtained aromatic ether compound.

Main peaks.

| | |
|---|---|
| νC—H | 2800 to 3000 cm$^{-1}$ |
| δC—H | 1460 cm$^{-1}$ |
| C=C | 1505 cm$^{-1}$, 1580 cm$^{-1}$, 1605 cm$^{-1}$ |
| νC—O—C | 1090 cm$^{-1}$ |

Table 1 shows the evaluation of lubricating oil basic performance of the obtained aromatic ether compound.

EXAMPLE 2

An aromatic ether compound was obtained in an amount of 396 g by carrying out the procedure in the same manner as in Example 1 with the exception of using 497 g of a p-t-butylphenol/1 mole ethylene oxide aduct [trade name, PTBP-EO, molecular weight of 194, produced by Toho Kagaku Kogyo Co.] instead of using p-t-amylphen ol/1 mole ethylene oxide aduct of Example 1.

The obtained aromatic ether compound was liquid and possessed a purity of 96% as a result of GC analysis. From the result of $^1$H-NMR analysis and IR analysis, it was learned that the aromatic ether compound was a p-t-butylphenoxyethylene mono-t-butyl ether having the following structure, $$(CH_3)_3C—C_6H_4—O—C_2H_4O—C(CH_3)_3$$

Measurement of the obtained aromatic ether compound by $^1$H-NMR indicated the following peaks on the chart. During the measurement, $CDCl_3$ was used as a solvent.

1.20 ppm, 1.28 ppm, 3.68 ppm, 4.05 ppm, 6.83 ppm, 7.25 ppm.

Infrared-ray absorption spectrum of the obtained aromatic ether compound is shown in FIG. 1.

Main peaks.

| | |
|---|---|
| νC—H | 2800 to 3000 cm$^{-1}$ |
| δC—H | 1460 cm$^{-1}$ |
| C=C | 1505 cm$^{-1}$, 1580 cm$^{-1}$, 1605 cm$^{-1}$ |
| νC—O—C | 1090 cm$^{-1}$ |

Table 1 shows the evaluation of lubricating oil basic performance of the obtained aromatic ether compound.

EXAMPLE 3

An aromatic ether compound was obtained in an amount of 296 g by carrying out the procedure in the same manner as in Example 1 with the exception of using 506 g of an o-p-di-t-butylphenol/1 mol ethylene oxide aduct [trade name, DTBP-EO, molecular weight of 250, produced by Toho Kagaku Kogyo Co.] instead of using p-t-amylphenol/1 mol ethylene oxide aduct of Example 1.

The obtained aromatic ether compound was liquid and possessed a purity of 97% as a result of GC analysis. From the result of $^1$H-NMR analysis and IR analysis, it was learned that the aromatic ether compound was an o,p-di-t-butylphenoxyethylene mono-t-butyl ether having the following structure,

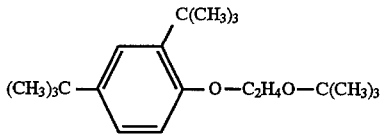

Measurement of the obtained aromatic ether compound by $^1$H-NMR indicated the following peaks on the chart. During the measurement, $CDCl_3$ was used as a solvent.

1.23 ppm, 1.30 ppm, 1.42 ppm, 3.74 ppm, 4.07 ppm, 6.78 ppm, 7.14 ppm, 7.31 ppm.

Described below are the data of an infrared-ray absorption spectrum of the obtained aromatic ether compound.

Main peaks.

| | |
|---|---|
| νC—H | 2800 to 3000 cm$^{-1}$ |
| δC—H | 1460 cm$^{-1}$ |
| C=C | 1495 cm$^{-1}$, 1580 cm$^{-1}$, 1602 cm$^{-1}$ |
| νC—O—C | 1090 cm$^{-1}$ |

Table 1 shows the evaluation of lubricating oil basic performance of the containing the obtained aromatic ether compound.

EXAMPLE 4

An aromatic ether compound was obtained in an amount of 496 g by carrying out the procedure in the same manner as in Example 1 with the exception of using 600 g of a p-isooctylphenol/1 mol ethylene oxide aduct [trade name, POP-EO, molecular weight of 250, produced by Toho Kagaku Kogyo Co.] instead of using p-t-amylphenol/1 mol ethylene oxide aduct of Example 1.

The obtained aromatic ether compound was liquid and possessed a purity of 96% as a result of GC analysis. From the result of $^1$H-NMR analysis and IR analysis, it was learned that the aromatic ether compound was a p-isooctylphenoxyethylene mono-t-butyl ether having the following structure, $$(CH_3)_3CCH_2C(CH_3)_2—C_6H_4—O—C_2H_4O—C(CH_3)_3$$

Measurement of the obtained aromatic ether compound by $^1$H-NMR indicated the following peaks on the chart. During the measurement, $CDCl_3$ was used as a solvent.

0.70 ppm, 1.22 ppm, 1.33 ppm, 3.70 ppm, 4.05 ppm, 6.82 ppm, 7.25 ppm.

Described below are the data of an infrared-ray absorption spectrum of the obtained aromatic ether compound.

Main peaks.

| | |
|---|---|
| νC—H | 2800 to 3000 $cm^{-1}$ |
| δC—H | 1460 $cm^{-1}$ |
| C=C | 1495 $cm^{-1}$, 1580 $cm^{-1}$, 1602 $cm^{-1}$ |
| νC—O—C | 1090 $cm^{-1}$ |

Table 1 shows the evaluation of lubricating oil basic performance of the obtained aromatic ether compound.

EXAMPLE 5

Into a flask having a capacity of 3 liters were fed 250 g of an o,p-di-t-butylphenol/1 mol ethylene oxide aduct [tradename PTBP-EO, molecular weight of 250 produced by Toho Kagaku Kogyo Co.], 1000 ml of toluene, 120 g of sodium hydroxide, 120 g of water and 1 g of tetrabutylammonium sulfate, and the reaction was carried out for 7 hours while slowly and dropwisely adding 140 ml of dimethyl sulfate at a temperature of from 40° to 50° C.

After the reaction, the product was washed with water, and toluene was removed followed by isolation by distillation to obtain 153 g of an aromatic ether compound.

The aromatic ether compound was liquid and possessed a purity of 90% as a result of GC analysis. From the result of $^1$H-NMR analysis and IR analysis, it was learned that the aromatic ether compound was an o,p-di-butylphenoxyethylene mono-t-butyl ether having the following structure,

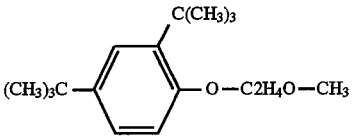

Measurement of the obtained aromatic ether compound by $^1$H-NMR indicated the following peaks on the chart. During the measurement, $CDCl_3$ was used as a solvent.

1.30 ppm, 1.42 ppm, 3.35 ppm, 3.74 ppm, 4.07 ppm, 6.78 ppm, 7.14 ppm, 7.31 ppm.

Figure 2:
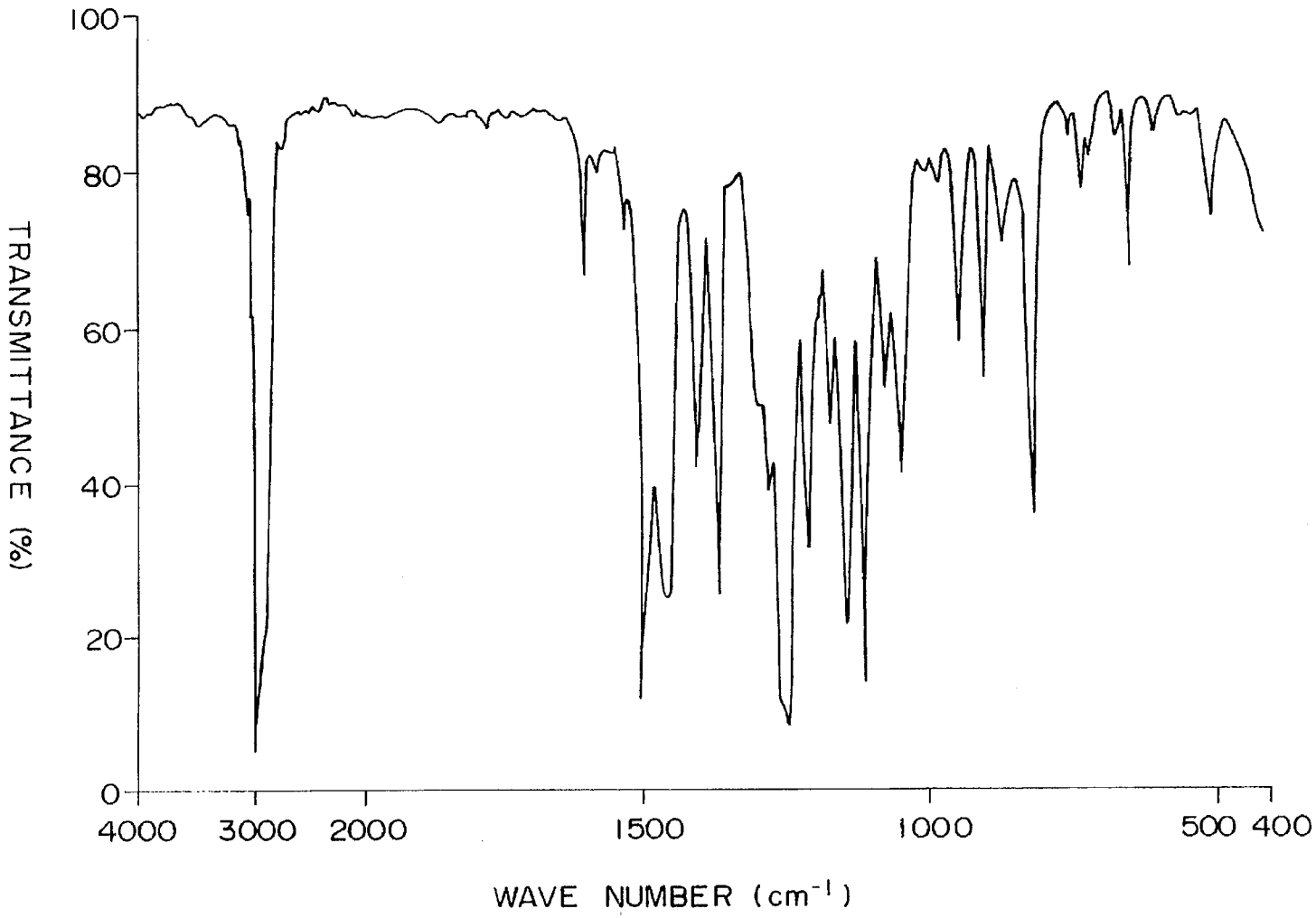
FIG. 2 is a diagram of an infrared-ray absorption spectrum used as a lubricating oil of an aromatic ether compound (Example5) of the present invention.

Infrared-ray absorption spectrum of the obtained aromatic ether compound as shown in FIG. 2.

Main peaks.

| | |
|---|---|
| νC—H | 2800 to 3000 $cm^{-1}$ |
| δC—H | 1460 $cm^{-1}$ |
| C=C | 1495 $cm^{-1}$, 1580 $cm^{-1}$, 1602 $cm^{-1}$ |
| νC—O—C | 1090 $cm^{-1}$ |

Table 1 shows the evaluation of lubricating oil basic performance of the obtained aromatic ether compound.

EXAMPLE 6

An aromatic ether compound was obtained in an amount of 202 g by carrying out the procedure in the same manner as in Example 5 with the exception of using 250 g of a p-isooctylphenol/1 mol ethylene oxide aduct [trade name, POP-EO, molecular weight of 250, produced by Toho Kagaku Kogyo Co.] instead of using o,p-di-t-butylphenol/1 mol ethylene oxide aduct of Example 5.

The aromatic ether compound that was liquid and possessed a purity of 95% as a result of GC analysis. From the result of $^1$H-NMR analysis and IR analysis, it was learned that the aromatic ether compound was a p-isooctylphenoxyethylene monomethyl ether having the following structure, $$(CH_3)_3CCH_2C(CH_3)_2—C_6H_4—O—C_2H_4O—CH_3$$

Measurement of the obtained aromatic ether compound by $^1$H-NMR indicated the following peaks on the chart. During the measurement, $CDCl_3$ was used as a solvent.

0.68 ppm, 1.33 ppm, 1.70 ppm, 3.35 ppm, 3.70 ppm, 4.05 ppm, 6.82 ppm, 7.24 ppm.

Described below are the data of an infrared-ray absorption spectrum of the obtained aromatic ether compound.

Main peaks.

| | |
|---|---|
| νC—H | 2800 to 3000 $cm^{-1}$ |
| δC—H | 1460 $cm^{-1}$ |
| C=C | 1495 $cm^{-1}$, 1580 $cm^{-1}$, 1602 $cm^{-1}$ |
| νC—O—C | 1090 $cm^{-1}$ |

Table 1 shows the evaluation of lubricating oil basic performance of the obtained aromatic ether compound.

EXAMPLE 7

An aromatic ether compound was obtained in an amount of 202 g by carrying out the procedure in the same manner as in Example 1 with the exception of using 274 g of a p-isononylphenol/1 mol propylene oxide aduct [trade name, PNP-EO, molecular weight of 274, produced by Toho Kagaku Kogyo Co.] instead of using o,p-di-t-butylphenol/1 mol ethylene oxide aduct of Example 5.

The aromatic ether compound was liquid and possessed a purity of 93% as a result of GC analysis. From the result of $^1$H-NMR analysis and IR analysis, it was learned that the aromatic ether compound was a p-isooctylphenoxypropylene monomethyl ether having the following structure, $$C_3H_7CH(CH_3)CH_2C(CH_3)_2—C_6H_4—O—CH_2CH(CH_3)O—CH_3$$

Measurement of the obtained aromatic ether compound by $^1$H-NMR indicated the following peaks on the chart. During the measurement, $CDCl_3$ was used as a solvent.

0.68 ppm, 1.15 ppm, 1.33 ppm, 1.70 ppm, 3.35 ppm, 3.70 ppm, 4.05 ppm, 6.82 ppm, 7.24 ppm Described below are the data of an infrared-ray absorption spectrum of the obtained aromatic ether compound.

Main peaks.

| | |
|---|---|
| νC—H | 2800 to 3000 $cm^{-1}$ |
| δC—H | 1460 $cm^{-1}$ |

-continued

| | |
|---|---|
| C=C | 1495 $cm^{-1}$, 1580 $cm^{-1}$, 1602 $cm^{-1}$ |
| νC—O—C | 1090 $cm^{-1}$ |

Table 1 shows the evaluation of lubricating oil basic performance of the obtained aromatic ether compound.

COMPARATIVE EXAMPLE 1

An aliphatic ether compound was obtained by carrying out the procedure in the same manner as in Example 5 with the exception of using 308 g of a trimethylolpropane/3 mols propylene oxide aduct [trade name, TMP-PO, molecular weight of 308, produced by Toho Kagaku Kogyo Co.] instead of using o,p-di-t-butylphenol/1 mol ethylene oxide aduct of Example 5.

The aliphatic ether compound was liquid and possessed a purity of 97% as a result of GC analysis. From the result of $^1$H-NMR analysis and IR analysis, it was learned that the aliphatic ether compound was a terminal trimethyl ether that corresponded to a trimethylolpropane/3 mols propylene oxide aduct and having the following structure, $$CH_3CH_2C(CH_2OCH_2CH_2CH_2OCH_3)_3$$

Table 1 shows the evaluation of lubricating oil basic performance of the obtained aliphatic ether compound.

EXAMPLE 8

An aromatic ether compound was obtained in an amount of 212 g by carrying out the procedure in the same manner as in Example 5 with the exception of using 250 g of a p-isononylphenol/3 mols ethylene oxide aduct [molecular weight of 362, produced by Toho Kagaku Kogyo Co.].

The aromatic ether compound was liquid and possessed a purity of 96% as a result of GC analysis. From the result of $^1$H-NMR analysis and IR analysis, it was learned that the aromatic ether compound possessed the following structure, $$C_3H_7CH(CH_3)—CH_2C(CH_3)_2—(C_6H_4)—O—(C_2H_4O)_3CH_3$$

Table 1 shows the evaluation of lubricating oil basic performance of the obtained aromatic ether compound.

EXAMPLE 9

An aromatic ether compound was obtained in an amount of 286 g by carrying out the procedure in the same manner as in Example 5 with the exception of using 300 g of a p-isononylphenol/3 mols propylene oxide aduct [molecular weight of 404, produced by Toho Kagaku Kogyo Co.].

The aromatic ether compound was liquid and possessed a purity of 96% as a result of GC analysis. From the result of $^1$H-NMR analysis and IR analysis, it was learned that the aromatic ether compound possessed the following structure, $$C_3H_7CH(CH_3)—CH_2C(CH_3)_2—(C_6H_4)—O—[CH_2CH(CH_3)O]_3CH_3$$

Table 1 shows the evaluation of lubricating oil basic performance of the obtained aromatic ether compound.

EXAMPLE 10

An aromatic ether compound was obtained in an amount of 336 g by carrying out the procedure in the same manner as in Example 5 with the exception of using 350 g of a p-isononylphenol/3 mols ethylene oxide and 3 mols propylene oxide random aduct [molecular weight of 468, produced by Toho Kagaku Kogyo Co.].

The aromatic ether compound was liquid and possessed a purity of 96% as a result of GC analysis. From the result of $^1$H-NMR analysis and IR analysis, it was learned that the aromatic ether compound possessed the following structure, $$C_3H_7CH(CH_3)—CH_2C(CH_3)_2—(C_6H_4)—O—(C_2H_4O)_3[CH_2CH(CH_3)O]_3CH_3$$

Table 1 shows the evaluation of lubricating oil basic performance of the obtained aromatic ether compound.

EXAMPLE 11

An aromatic ether compound was obtained in an amount of 522 g by carrying out the procedure in the same manner as in Example 1 with the exception of using 503 g of a p-isooctylphenol/4 mols ethylene oxide aduct [molecular weight of 382, produced by Toho Kagaku Kogyo Co.].

The aromatic ether compound was liquid and possessed a purity of 95% as a result of GC analysis. From the result of $^1$H-NMR analysis and IR analysis, it was learned that the aromatic ether compound possessed the following structure, $$(CH_3)_3CCH_2C(CH_3)_2—(C_6H_4)—O—(C_2H_4O)_4—C(CH_3)_3$$

Table 1 shows the evaluation of lubricating oil basic performance of the obtained aromatic ether compound.

EXAMPLE 12

An aromatic ether compound was obtained in an amount of 431 g by carrying out the procedure in the same manner as in Example 1 with the exception of using 405 g of a p-t-butylphenol/4 mols propylene oxide and 2 mols ethylene oxide block aduct [molecular weight of 406, produced by Toho Kagaku Kogyo Co.].

The aromatic ether compound was liquid and possessed a purity of 97% as a result of GC analysis. From the result of $^1$H-NMR analysis and IR analysis, it was learned that the aromatic ether compound possessed the following structure, $$C(CH_3)_4—(C_6H_4)—O—[C_2H_4(CH_3)]_4(C_2H_4O)_2—C(CH_3)_3$$

Table 1 shows the evaluation of lubricating oil basic performance of the obtained aromatic ether compound.

TABLE 1

| | Compa. Ex.1 | Ex.1 | Ex.2 | Ex.3 | Ex.4 | Ex.5 | Ex.6 | Ex.7 | Ex.8 | Ex.9 | Ex.10 | Ex.11 | Ex.12 |
|---|---|---|---|---|---|---|---|---|---|---|---|---|---|
| Kinematic viscosity at 40° C. (cSt) | 5.4 | 9.6 | 7.8 | 30.5 | 28.7 | 10.7 | 11.3 | 7.6 | 16.2 | 34.1 | 32.7 | 48.7 | 28.6 |

TABLE 1-continued

| | Compa. Ex.1 | Ex.1 | Ex.2 | Ex.3 | Ex.4 | Ex.5 | Ex.6 | Ex.7 | Ex.8 | Ex.9 | Ex.10 | Ex.11 | Ex.12 |
|---|---|---|---|---|---|---|---|---|---|---|---|---|---|
| Load carrying value (lbf) | 780 | 900 | 860 | 950 | 950 | 930 | 900 | 950 | 980 | 990 | 1020 | 950 | 980 |
| Volume resistivity ($\Omega \cdot$ cm) | $7 \times 10^{13}$ | $2 \times 10^{13}$ | $7 \times 10^{13}$ | $9 \times 10^{13}$ | $7 \times 10^{13}$ | $3 \times 10^{13}$ | $1 \times 10^{13}$ | $6 \times 10^{12}$ | $8 \times 10^{11}$ | $2 \times 10^{12}$ | $7 \times 10^{11}$ | $6 \times 10^{11}$ | $2 \times 10^{12}$ |
| Compatibility with R-134a | | | | | | | | | | | | | |
| (1)(note 1) | good | good | good | good | good | good | good | good | good | good | good | good | good |
| (2)critical temp.(°C.) | | | | | | | | | | | | | |
| High temp. side | 80 or more | 80 or more | 80 or more | 80 or more | 80 or more | 80 or more | 80 or more | 80 or more | 80 or more | 80 or more | 63 | 78 | 75 |
| Low temp. side (note 2) | −65 or less | −60 | −65 or less | −46 | −35 | −62 or less | −65 | −55 | −48 | −35 | −32 | −33 | −60 |

note 1: good; Compatible, bad: Not compatible.
Note 2: lubricating oil: 3% by weight, R-134a: 97% by weight.

We claim:

1. A lubricating oil containing an aromatic ether compound in an amount of not smaller than 50% by weight wherein said aromatic ether compound is at least one compound of a mono- or dialkyl group substituted phenoxyoxyalkylene ether selected from the group consisting of p-t-amylphenoxyethylene mono-t-butyl ether, p-t-butylphenoxyethylene mono-t-butyl ether, p-isooctylphenoxyethylene mono-t-butyl ether, p-isooctylphenoxypropylene mono-methyl ether, p-isooctylphenoxyethylene mono-methyl ether, o-di-t-butylphenoxyethylene mono-t-butyl ether, p-di-t-butylphenoxyethylene mono-t-butyl ether, o-di-t-butylphenoxyethylene monomethyl ether and p-di-t-butylphenoxyethylene monomethyl ether.

2. A lubricating oil according to claim 1, wherein said lubricating oil is used for refrigerators.

3. A lubricating oil according to claim 2, wherein said lubricating oil contains ozone layer non-depleting hydrogenerated fluorocarbons.

4. A lubricating oil according to claim 1, wherein said lubricating oil is an electrically insulating oil.

5. A lubricating oil containing an aromatic ether compound in an amount of not smaller than 50% by weight, wherein said aromatic ether compound is a fluoroalkyl group containing aromatic ether compound represented by the following general formula (1)

$$CF_3—Ph—O—(R^2O)_m—R^3 \quad (I)$$

wherein $R^2$ stands for an alkylene group having 2 to 4 carbon atoms, $R^3$ stands for an alkyl group having 1 to 9 carbon atoms, and m stands for an integer of 1 to 3.

6. A lubricating oil according to claim 5, wherein said lubricating oil is used for refrigerators.

7. A lubricating oil according to claim 6, wherein said lubricating oil contains ozone layer non-depleting hydrogenated fluorocarbon.

8. A lubricating oil according to claim 5, wherein said lubricating oil is an electrically insulating oil.

* * * * *